United States Patent [19]

Hudelmaier

[11] Patent Number: 4,614,483

[45] Date of Patent: Sep. 30, 1986

[54] DEVICE FOR SEALING A CONCRETE PUMP

[76] Inventor: Gerhard Hudelmaier, Sylvanerweg 19, D-7900 Ulm, Fed. Rep. of Germany

[21] Appl. No.: 713,254

[22] Filed: Mar. 18, 1985

[30] Foreign Application Priority Data

Mar. 20, 1984 [DE] Fed. Rep. of Germany ..... 3410211

[51] Int. Cl.[4] ..... F04B 14/02; F04B 21/00; F17D 1/14

[52] U.S. Cl. ..... 417/517; 417/519; 417/532; 417/900; 137/625.44; 251/159

[58] Field of Search ..... 417/516–520, 417/900, 531, 532; 137/874, 875, 625.44; 251/159

[56] References Cited

U.S. PATENT DOCUMENTS

| | | | |
|---|---|---|---|
| 3,601,511 | 8/1971 | Massenbach | 417/519 X |
| 3,762,664 | 10/1973 | Loveless | 137/874 X |
| 4,063,572 | 12/1977 | Anderegg | 251/161 X |
| 4,198,193 | 4/1980 | Westerlund et al. | 417/900 X |

FOREIGN PATENT DOCUMENTS

| | | | |
|---|---|---|---|
| 52192 | 5/1982 | European Pat. Off. | 417/900 |
| 2315857 | 10/1974 | Fed. Rep. of Germany . | |
| 2921735 | 12/1980 | Fed. Rep. of Germany | 417/900 |
| 3042932 | 7/1982 | Fed. Rep. of Germany . | |

*Primary Examiner*—Carlton R. Croyle
*Assistant Examiner*—Theodore W. Olds
*Attorney, Agent, or Firm*—James E. Nilles

[57] ABSTRACT

The invention relates to a device for sealing in the zone of contact between the mouths of alternately charging and discharging delivery cylinders of a concrete pump and a swinging pipe that is alternately movable to alignment in front of the cylinder that is discharging at the time. It comprises an annular seal body so supported at the mouth zone of the delivery cylinder as to be slidable between a sealing position projecting into the rear end portion of the swinging pipe and a withdrawn releasing position in which it is spaced from the swinging pipe so as not to interfere with its swinging. The seal body is maintained in its withdrawn position whenever the swinging pipe is moving, thus substantially avoiding abrasion.

12 Claims, 8 Drawing Figures

DEVICE FOR SEALING A CONCRETE PUMP

This invention relates to improvements in concrete pumps, and more particularly to a device for sealing the zone of contact between the front ends of a pair of alternately charging and discharging delivery cylinders and the adjacent rear end of a swinging pipe that swings between those cylinders to be aligned with the one that is discharging.

In a known device of this type (German Offenlegungsschrift No. 2,921,735) an annular seal body is mounted in the rear end of the swinging pipe. It protrudes all around from the annular groove in which it is seated and in this position is loaded by pressure of a locked pressure system which is likewise arranged in the wall of the swinging pipe. The pressure system is sealed off from the interior of the swinging pipe by a sealing ring that is elastically deformable inwardly into the pressure system by the pressure in the swinging pipe. By this the pressure on the sealing body is increased when the pressure in the swinging pipe rises, that is, when concrete is brought into it under pressure from a delivery cylinder. The sealing effect is thereby strengthened. It is disadvantageous that the seal body also protrudes beyond the rear end of the swinging pipe when there is little pressure in it. With every swinging movement of the swinging pipe, it therefore slides with its annular sealing surface on a spectacle plate that surrounds the mouths of the delivery cylinders. The always existing pressure loading causes rubbing force on the sealing surface, and with it abrasion, to be very large. With the known apparatus, it is in fact provided for that abrasion on the seal body is equalized by means of increase in pressure. Nevertheless, the abrasion is not uniform over the whole surface and there are thus unevennesses on the sealing surface that cannot be further smoothed out by the pressing force. If the sealing effect decreases because of this, moisture can escape. The concrete which is partly dewatered in this way is more difficult to discharge because the effectiveness of the dried out water-cement slurry as a lubricating medium is lost. In addition, the makeup of the mixture is changed, and hence the properties of the finished concrete.

The invention has as its object to provide a device of the type described in the introduction whereby a secure sealing is assured through a long operating life.

This object is obtained according to the invention by means of a seal body that is seated in the mouth portion of each delivery cylinder for movement axially relative to the cylinder so that it can be brought for sealing into engagement against the swinging pipe when that pipe is stopped in front of the cylinder and can be drawn back from the swinging pipe before it begins to swing away from alignment with the cylinder, to a withdrawn position in which the swinging motion of the pipe no longer affects it. Consequently no wear can occur from rubbing, abrasion or the like. In this way, not only is the useful life of the seal body substantially increased but the trouble-free condition of the sealing zone is assured with the employment of relatively small seating force. The zone in which the seal body is mounted therefore does not have to be formed in an expensive manner for high pressures. The same holds true for possible adjustment devices. The seating of the seal body in a stationary zone of the delivery cylinder mouth has the additional advantage that the sealing of the seal body, and also the arrangement of a controlled drive, is made possible in a simple manner and without special space and protection problems.

With the seal body provided with a sealing surface that is engageable with the swinging pipe by linear movement, there can be a further reduction of the driving force exerted on the seal body with the same seating force.

When the swinging pipe has adjacent to its rear end a conical surface that converges inwardly, and the sealing edge of the seal body lies thereagainst in the sealing position, the zones of the swinging pipe and of the seal body that cooperate for sealing are especially simple to produce.

A still further improved sealing effect is obtained when the swinging pipe has an annular groove in its rear edge and the seal body has a sealing edge that engages in that groove, tongue-fashion, in the sealing position. This tongue and groove seal offers an additional increase in the sealing effect. It further compels an exact placement between the swinging pipe and the cylinder mouth or seal body.

The movement of the seal body into and out of the sealing position can be accomplished in a simple manner by a purely axial movement.

In an apparatus wherein the delivery cylinders discharge through mouth openings in a partition wall on the exterior of which the rear end of the swinging pipe slides, the sealing edge of the seal body is protected by the partition wall whenever the swinging pipe is moving and when the delivery cylinder is charging.

The axial movement of the seal body can be effected in a simple manner. The seal body can be rotated in synchronism with movement of the swinging pipe and the mouth zone of the delivery cylinder can cooperate with the seal body to translate rotation of the latter into axial movement thereof. Or a pipe section can be arranged around the seal body to make possible a hydraulic or pneumatic actuation of it and also partially serve for its guidance. The same is true for the mouth openings of the partition wall. In this manner undesired movements that diverge from the axial direction in the movements of the seal body are in the main prevented and also, in relation to the guide surfaces, abrasion is curtailed to a minimum. In other respects the seal body seals off the mouth openings in the partition wall in all positions.

In another embodiment in which the axial displacement of the seal body is brought about by a swinging movement, the drive for moving the seal body can mechanically engage it directly. The pressure chamber and pressure connections, with the appurtenant sealing means, are thereby eliminated from the region directly at the mouth of the delivery cylinder.

The control of the movement of the seal body, in dependence upon the movement of the swinging pipe or upon the pumping cycle of the delivery cylinders can be accomplished mechanically in various ways. With a preferred embodiment the control is accomplished in dependence upon the pressure in the delivery cylinder. The sealing position is thus maintained only so long as the pumping pressure in the related delivery cylinder has a predetermined magnitude.

Embodiments of the invention are illustrated in the drawings, wherein.

Figure 1:
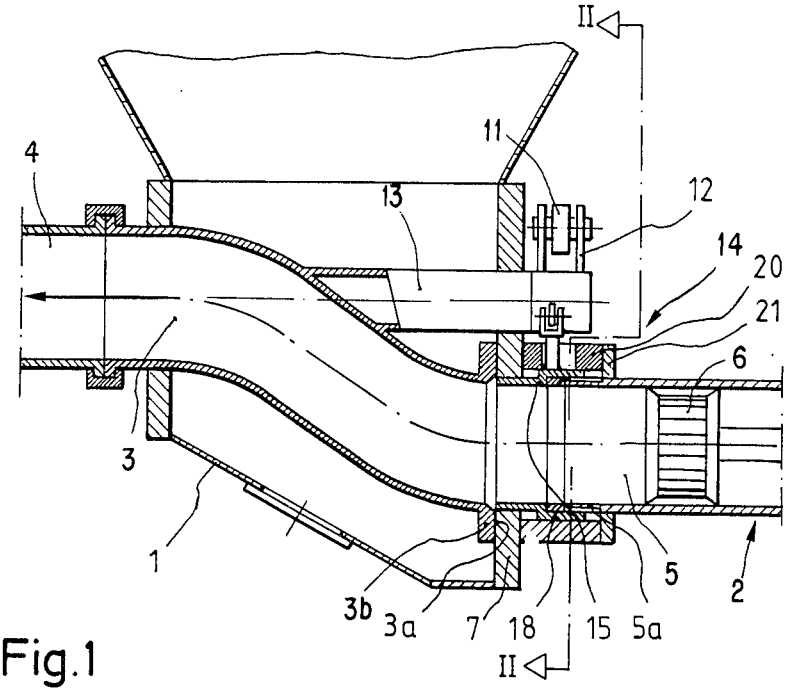
FIG. 1 is a schematic vertical section through the zone of connection between a swinging pipe of a concrete pump and a sealing device according to the invention.

From a concrete hopper 1 concrete is conveyed in the direction of the arrow A by means of a concrete pump 2, through a swinging pipe 3 to a delivery duct 4. Of the concrete pump 2 there are illustrated only the delivery cylinders 5 and the pistons 6 that move backward and forward in them for intake and discharge. The delivery duct 4 is indicated in FIG. 1 by a fragment flanged to the swinging pipe. As is well known, concrete is drawn from the hopper 1 by a charging delivery cylinder 5 while the swinging pipe 3 is aligned with the other delivery cylinder, which is then discharging. At the end of the discharging stroke of a cylinder, the swinging pipe 3 swings into alignment with the delivery cylinder that has been charging, to conduct to the delivery duct 4 the concrete to be discharged from it.

Between the swinging pipe 3 and the mouth portions 5*a* of the delivery cylinders 5 there is arranged a partition wall 7 belonging to the concrete hopper 1. It has two mouth openings 8 that align axially with the mouth portions 5*a* of the delivery cylinders, each having a circular cross-section and a diameter corresponding to the inside diameter of the delivery cylinder 5.

The swinging pipe 3 has its rear end 3*a* lying against the exterior of the partition wall 7. The rear end 3*a* is annular and by reason of a flange 3*b* is larger in outside diameter than the rest of the cross-section of the swinging pipe. The swinging pipe is movable in the directions of the arrows B in FIG. 2 to bring its rear end 3*a* in front of the mouth opening 8 of the cylinder then discharging. The swinging pipe is actuated by means of a hydraulic cylinder 9 which is swingably mounted, as at 10, on the concrete hopper and which has a piston rod 11 that actuates a drive shaft 13 for the swinging pipe by means of a fork arm 12.

Between the mouth portion 5*a* of each delivery cylinder and its associated mouth opening 8 in the partition wall 7 there is arranged a sealing device generally designated by 14. Its most essential structural element is a seal body 15 in the form of a stepped down pipe body, as seen most clearly in FIG. 3. The seal body 15 has a first or front pipe section 15*a*, the inside diameter of which is equal to the inside diameter of the mouth portion 5*a* of the delivery cylinder, and it has a second or rear pipe section 15*b* which is larger than the first pipe section 15*a* in both inside diameter and outside diameter. In its interior the second pipe section 15*b* has a threaded zone 16 that cooperates with an external thread 17 on the mouth portion 5*a* of the delivery cylinder. The seal body 15 is mounted on the delivery cylinder 5 in such a manner that the first pipe section 15*a* extends in front of the delivery cylinder 5 into the mouth opening 8 of the partition wall. An elastic seal ring 18 is confined in the zone between the inner surface of the second pipe section and the mouth of the delivery cylinder 5, in the zone of connection of the first pipe section 15*a* to the second pipe section 15*b*. The mouth opening 8 in the partition wall 7 contains an annular seal 19 in the zone of its support of the first pipe section 15*a*.

Figure 2:
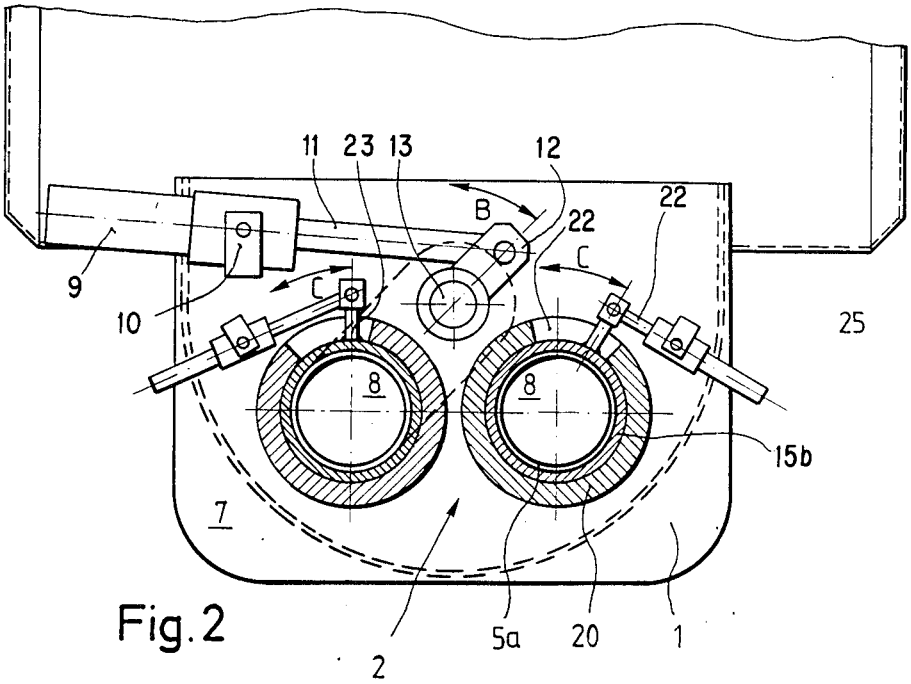
FIG. 2 is a section on the section line II—II in FIG. 1.

The second pipe section 15*b* of the seal body 15 is disposed with its exterior surface closely but slidably seated in the inner surface of a pipe piece 20. The pipe piece 20 is secured between the side of the partition wall 7 that faces the delivery cylinders 5 and a ring flange 21 that is received on each delivery cylinder 5 in the region of its mouth portion 5*a*. The pipe piece 20 is of such length that the second pipe section 15*b* has room for axial play between the ring flange 21 and the partition wall 7. Through a cutout 22 in the front end of the pipe piece 20 there extends an arm 23 that is mounted on the second pipe section 15*b* and projects radially from it. The arm 23 is engaged by the piston rod 24 of a control cylinder 25 in such a manner that by its back and forth movement it turns the seal body 15 in the directions of the double arrows C (Fig. 2). The cooperation of the thread 16 with the external thread 17 transforms this into an axial movement of the seal body.

The delivery of concrete from a currently discharging delivery cylinder 5 to the swinging pipe 3 is sealed off by the device 14 in the following manner:

The swinging pipe 3 is swung in front of the mouth opening 8. The control cylinder 25 is energized and brings about, through the arm 23 and the threads 16 and 17, an axial displacement of the seal body 15 into a sealing position in which the first pipe section 15*a* projects into the rear end portion of the swinging pipe 3. This brings a sealing edge 26 on the seal body into engagement around a circular line with an inwardly tapering conical surface 27 that is formed in the rear end portion of the swinging pipe 3. This position of the seal body 15 in relation to the swinging pipe 3 is illustrated on an enlarged scale in FIG. 4. There is thus obtained a circular line seal that prevents loss of moisture from concrete in the transition zone that has been forced into the swinging pipe from the delivery cylinder. At the end of the concrete discharge the seal body 15 is immediately drawn back into the mouth opening 8 by the operation of the control cylinder 25, before the swinging pipe 3 can be swung in front of the other mouth opening 8 by actuation of the hydraulic cylinder 9. The sealing edge 26 is thus subjected to no abrasion as a result of the swinging movement.

Figure 3:
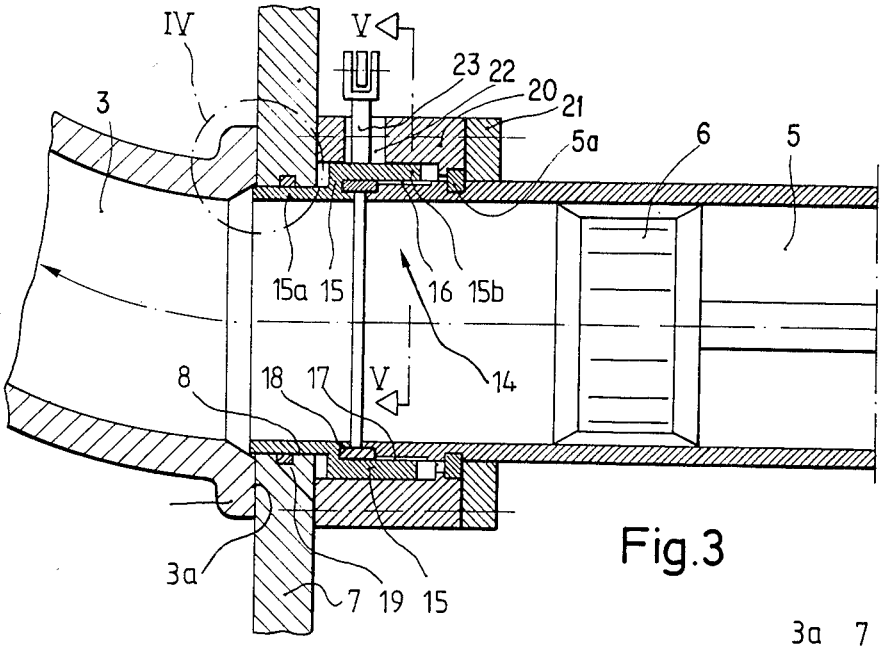
FIG. 3 is a view of a part of FIG. 1, on a larger scale.
Figure 5:
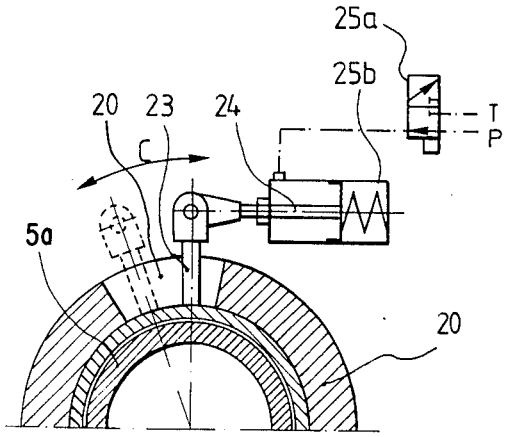
FIG. 5 is a section on the line V—V in FIG. 3.

FIG. 5 shows, in an illustration corresponding to the section line V—V in FIG. 3, the movement of the arm 23 under the influence of a control cylinder 25. The control cylinder is connected with a pressure connection 25*a*. Its piston is arranged with a return spring 25*b* for moving the arm 23 to the position shown by broken lines.

Figure 4:
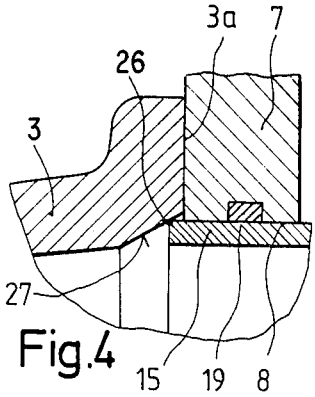
FIG. 4 is an enlarged showing of the area designated by IV in FIG. 3.
Figure 6:
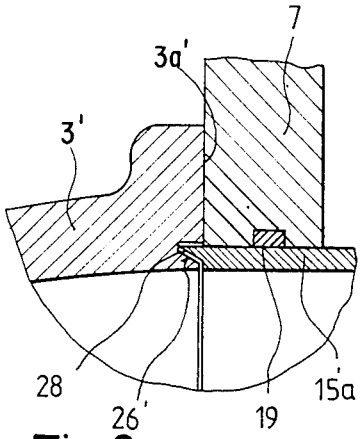
FIG. 6 is a fragmentary view like FIG. 4, but illustrating a different embodiment of the sealing device.

FIG. 6 shows, in an illustration generally corresponding to FIG. 4, another form of the rear end 3*a*′, as well as a first pipe section 15*a*′. In the rear end 3*a*′ an annular groove 28 is formed. The sealing edge 26′, in the sealing position, engages in the annular groove 28 in the manner of a tongue-and-groove connection.

Figure 7:
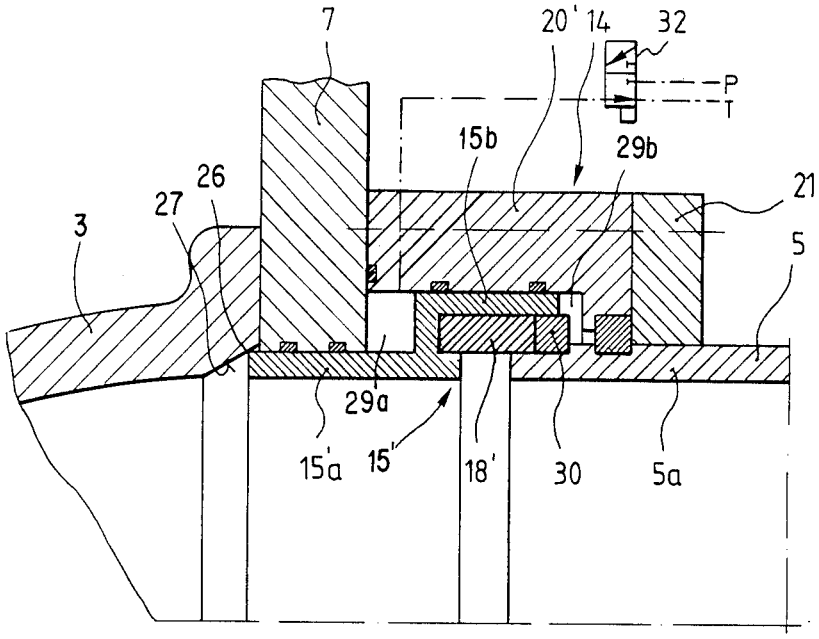
FIG. 7 is a further embodiment of the sealing device, also shown in vertical section.
Figure 8:
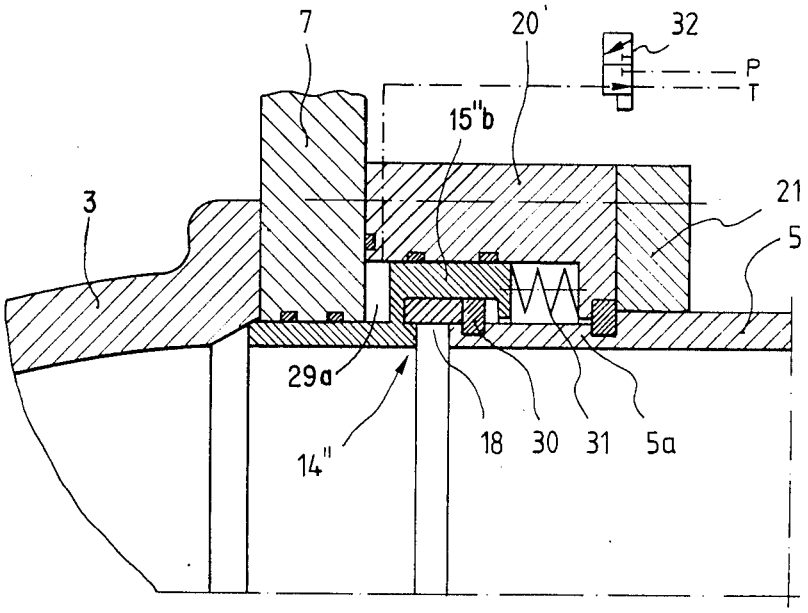
FIG. 8 is a further embodiment, likewise in vertical section.

FIGS. 7 and 8 show sealing devices 14′ and 14″ respectively. Structural elements which correspond to those illustrated in FIGS. 1 to 5 and already described are designated by the same reference characters.

In the device 14′ (FIG. 7), a pipe piece 20′ which is closed around its circumference defines an annular space in cooperation with the partition wall 7 on the one hand and with the annular flange 21 on the other hand, as well as with a portion of the outer surface of the mouth portion 5a and a portion of the outer surface of the first pipe section 14a', which space is divided by the second pipe section 15b' of the seal body 15' into an annular chamber 29a adjacent to the partition wall 7 and an annular chamber 29b adjacent to the annular flange 21. The second pipe section 15b' has its outer surface closely slidably fitted to the inner surface of the pipe section 20'. To the interior of the mouth portion 5a of the delivery cylinder and its prolongation formed by the first pipe section 15a' the second pipe section 15b' is sealed by means of a sealing ring 18' which at the same time forms an elastic biasing means that loads the seal body 15' in the direction of the sealing position. The sealing ring 18' is held between the mouth portion 5a and the second pipe section 15b' by means of a retainer ring 30.

A pressure connection 32 has its outlet in the annular chamber 29a adjacent to the partition wall 7. When the annular chamber 29a is unpressurized, the seal body 15' is urged by the sealing ring 18' to the sealing position illustrated in FIG. 7, in which the sealing edge 26 of the seal body 15' engages against the conical surface 27 of the swinging pipe 3. For drawing back the seal body 15' before the swinging movement of the swinging pipe begins, the annular chamber 29a is pressurized. The second pipe section 15b' is displaced piston-fashion in the direction towards the annular flange 21, and the sealing edge 26 is moved into the mouth opening 8 of the partition wall 7 and thus out of the way of the swinging pipe 3. The seal body is held in this position until the swinging pipe 3 again arrives in front of the mouth opening 8 of the associated delivery cylinder for a new concrete delivery therefrom.

The sealing device 14" illustrated in FIG. 8 is distinguished from the device 14' of FIG. 7 in that an expansion spring 31 is situated in the annular chamber 29b as a biasing means and the elastic sealing ring 18 has no function as a source of biasing force. In addition, the end of the second pipe section 15b" that faces into the annular chamber 29b is so much enlarged in cross-section that it provides the expansion spring with a larger seat. The movement of the seal body into its releasing position is effected with the help of a pressure build-up in the annular chamber 29a; the movement into the sealing position is effected by the expansion spring 31 after relief of pressure in the annular chamber 29a.

The invention is not limited to these exemplary embodiments. Thus, elements of the configuration of the seal body and its mounting can be varied, such as its actuation for lengthwise movement. For example, in embodiments resembling FIGS. 7 and 8, the two annular chambers can be alternately pressurized. In all embodiments and their variations the zone of contact between the swinging pipe and the seal body can be formed according to FIG. 6.

Within the scope of the invention the seal body can be moved out of the releasing position and into the sealing position, and maintained there, while the swinging pipe is aligned with the neighboring delivery cylinder which is then discharged. It is then necessary that there be a movement back to the mouth opening in question. This is particularly the case in the embodiments illustrated in FIG. 7 and 8, wherein a pressure build-up in the annular chamber is necessary only for the duration of each swinging movement of the swinging pipe.

What is claimed as the invention is:

1. In a concrete pump having a pair of delivery cylinders which charge and discharge alternately and each of which has a front mouth portion through which it discharges, and a swinging pipe that has a rear end portion which moves from side to side to be aligned with the mouth portion of the delivery cylinder that is discharging, a sealing device for each delivery cylinder, providing a seal between its mouth portion and said rear end portion of the swinging pipe, said device being characterized by:

A. an annular seal body
  (1) having an axially slidable sealing connection with the mouth portion of the delivery cylinder,
  (2) having an end portion which can project coaxially beyond said mouth portion and towards said swinging pipe, and
  (3) being axially movable relative to the delivery cylinder between a sealing position in which its said end portion projects forwardly beyond said mouth portion and sealingly engages said rear end portion of the swinging pipe all around the same and a withdrawn position in which its said end portion is clear of the swinging pipe;

B. said rear end portion of said swinging pipe being formed to receive said end portion of the seal body therein when the seal body is in its said sealing position; and C. drive means connected with said seal body to move it between its said positions and whereby it is maintained in its withdrawn position whenever the swinging pipe is moving and is maintained in its sealing position while the swinging pipe is aligned with the delivery cylinder.

2. The concrete pump of claim 1 wherein said rear end portion of the swinging pipe has an inwardly convergent conical surface and said end portion of the seal body has an edge which makes substantially line contact with said conical surface around the same.

3. The concrete pump of claim 1 wherein said rear end portion of the swinging pipe has an annular rearwardly opening groove therein and said end portion of the sealing body has a coaxial forwardly projecting annular tongue thereon that is receivable in said groove.

4. The concrete pump of claim 1, further characterized in that said seal body is in the form of a stepped-down pipe having a larger diameter section which slidably but sealingly surrounds the mouth portion of the delivery cylinder and a coaxial smaller diameter section which extends between the mouth portion and the plane in which the rear end of the swinging pipe moves.

5. The concrete pump of claim 4 wherein said larger diameter section of the seal body is slidable piston-fashion on the mouth portion of the delivery cylinder, further characterized by:

(1) annular means coaxially surrounding said mouth portion and said larger diameter section and cooperating with them to define a pair of chambers which are at axially opposite sides of said larger diameter section; and (2) means for controlledly pressurizing at least one of said chambers to drive the seal body axially in the direction towards the other chamber.

6. The concrete pump of claim 5, further characterized by yieldable biasing means in the other of said chambers, reacting against the seal body to urge it axially in the opposite direction.

7. The concrete pump of claim 6 wherein said biasing means comprises an expansion spring.

8. The concrete pump of claim 5, further characterized by:

(1) said larger diameter section of the seal body having an inside diameter to be radially spaced from the delivery cylinder mouth portion that it surrounds; and (2) an elastic sealing ring confined between said larger diameter section and said mouth portion and projecting forwardly beyond said mouth portion to provide a seal between said mouth portion and the seal body.

9. The concrete pump of claim 8 wherein said one chamber is in front of said larger diameter section so that pressurization thereof moves the seal body to its withdrawn position, further characterized by:

(3) axially opposing abutments on said mouth portion and on said seal body, respectively, between which said sealing ring is axially confined and which cooperate to resiliently compress the sealing ring upon movement of the seal body to its withdrawn position so that the sealing ring biases the seal body towards it sealing position.

10. The concrete pump of claim 5 wherein said annular means comprises a pipe piece having an inside diameter which closely slidably fits around said larger diameter of the seal body, further characterized by:

(3) a partition wall adjacent to the mouth portions of the delivery cylinders and having therein a mouth opening for each delivery cylinder that is coaxial with the delivery cylinder, said partition wall having a front surface across which the rear end of the swinging pipe slides and having an opposite rear surface and being cooperable with said pipe piece and said smaller and larger diameter sections of the seal body to define a front one of said chambers; and (4) a ring flange on the delivery chamber, spaced behind said partition wall, cooperating with said pipe piece, the mouth portion of the delivery cylinder and the larger diameter section of the seal body to define a rear one of said chambers.

11. The concrete pump of claim 1 further characterized by cooperating guide means on said mouth portion and the seal body whereby rotation of the seal body in opposite directions is translated into respective axial motions of it towards its said positions.

12. The concrete pump of claim 11 further characterized by:

(1) a radially projecting arm on the seal body, and (2) a control cylinder actuator mounted adjacent to the seal body and having a piston rod which is connected to said arm for imparting swinging motion to the arm whereby the seal body is rotated.

* * * * *